US006241295B1

(12) United States Patent
Hoogendoorn

(10) Patent No.: US 6,241,295 B1
(45) Date of Patent: Jun. 5, 2001

(54) HANDLE MOUNTING ASSEMBLY

(75) Inventor: John Henri Hoogendoorn, Melbourne (AU)

(73) Assignee: Gainsborough Hardware Industries Limited, Blackbuirn (AU)

( * ) Notice: Subject to any disclaimer, the term of this patent is extended or adjusted under 35 U.S.C. 154(b) by 0 days.

(21) Appl. No.: 09/342,978

(22) Filed: Jun. 30, 1999

(30) Foreign Application Priority Data

Jun. 30, 1998 (AU) ..... PP4411

(51) Int. Cl.[7] ..... E05B 3/00

(52) U.S. Cl. ..... 292/348; 292/DIG. 64

(58) Field of Search ..... 70/462; 292/348, 292/349, 352, 353, 355, 356, 336.5, DIG. 64

(56) References Cited

U.S. PATENT DOCUMENTS 494,554 * 4/1893 Doebler ..... 292/355
843,047 * 2/1907 Voight ..... 292/356
2,317,592 * 4/1943 Dey ..... 292/352
2,459,920 * 1/1949 Clark ..... 292/348
2,707,649 * 5/1955 Young ..... 292/348
2,727,773 * 12/1955 Hagstrom ..... 292/169.19
5,732,578 * 3/1998 Kang ..... 70/224
5,761,936 * 6/1998 Katayama ..... 70/224

* cited by examiner

*Primary Examiner*—Gary W. Estremsky
(74) *Attorney, Agent, or Firm*—Sughrue, Mion, Zinn, Macpeak & Seas, PLLC

(57) ABSTRACT

A handle mounting assembly (10) includes a handle (12) adapted for turning about an axis (16), a drive member (18) operable on a latch and/or lock mechanism (17). The drive member (18) is rotatably mounted to the handle (12).

The assembly (10) also includes a handing plate (22) non-rotatably mounted to the handle (12). The handing plate (22) is adapted to non-rotatably engage the drive member (18) in at least two angularly spaced apart positions relative to the axis (16) of the handle (12).

12 Claims, 4 Drawing Sheets

HANDLE MOUNTING ASSEMBLY

FIELD OF THE INVENTION

The present invention relates to a handle mounting assembly.

The invention has been developed primarily for use in mounting lever handles for door locks and latches and will be described hereinafter with reference to this application. However, it will be appreciated that the invention is not limited to this particular field of use and is equally suitable for mounting all types of handle that are non-symmetric about their axis of rotation and/or otherwise have a preferred orientation relative to the door or other component to which they are mounted.

BACKGROUND OF THE INVENTION

Handles, such as those used for door locks and latches, can be broadly categorised as being symmetric about their rotational axis, for example knobs, and non-symmetric about their rotational axis, for example lever handles.

A problem associated with mounting non-symmetric handles, such as lever handles, is that it is customary for the free or gripping end of the handle to point towards the hinges of the door or like component. Accordingly, relative to the escutcheon or face plate, the handle on one side of a door is thus orientated 180° around its rotational axis away from the handle on the other side of the door. This results in door furniture suppliers having to manufacture different mounting assemblies so the handles always point towards the hinge regardless of what side of the door the hinge is on, and in the case of lockable doors, which side of the door is to be lockable.

It is an object of the present invention to overcome this disadvantage by providing a handle mounting assembly in which the orientation of the handle may be quickly and easily changed relative to the escutcheon or face plate.

SUMMARY OF THE INVENTION

Accordingly, in a first aspect, the present invention provides a handle mounting assembly including:

a handle adapted for turning about an axis;

a drive member operable on a latch and/or lock mechanism, the drive member being rotatably mounted to the handle; and a handing plate non-rotatably mounted to the handle, the handing plate adapted to non-rotatably engage the drive member in at least two angularly spaced apart positions relative to the axis of the handle.

Preferably, the handle is non-symmetric about its rotational axis. More preferably, the handle is a lever handle.

The drive member preferably includes at least two first engaging formations adapted for individual engagement with a corresponding engaging formation provided on the handing plate. In a preferred form, the drive member includes a pair of opposed recesses and the handing plate includes a correspondingly sized locking tab.

The handing plate preferably also includes second engaging portions adapted to engage with second complementary engaging formations provided on the handle. In a preferred form, the handle includes a spigot having a pair of opposed recesses into which is received a pair of opposed teeth provided on the handing plate.

The handing plate locking tab is preferably moveable in an axial direction in and out of engagement with the recesses. The handing plate is desirably biased against the drive member by a spring means. In one form, the handle, the drive member and the handing plate are all preferably biased towards an escutcheon plate by the spring means. The spring means is preferably in the form of a wave washer. The wave washer is desirably retained on the handle spigot by cir-clip engaging a groove therein.

DETAILED DESCRIPTION OF THE PREFERRED EMBODIMENT

Figure 1:
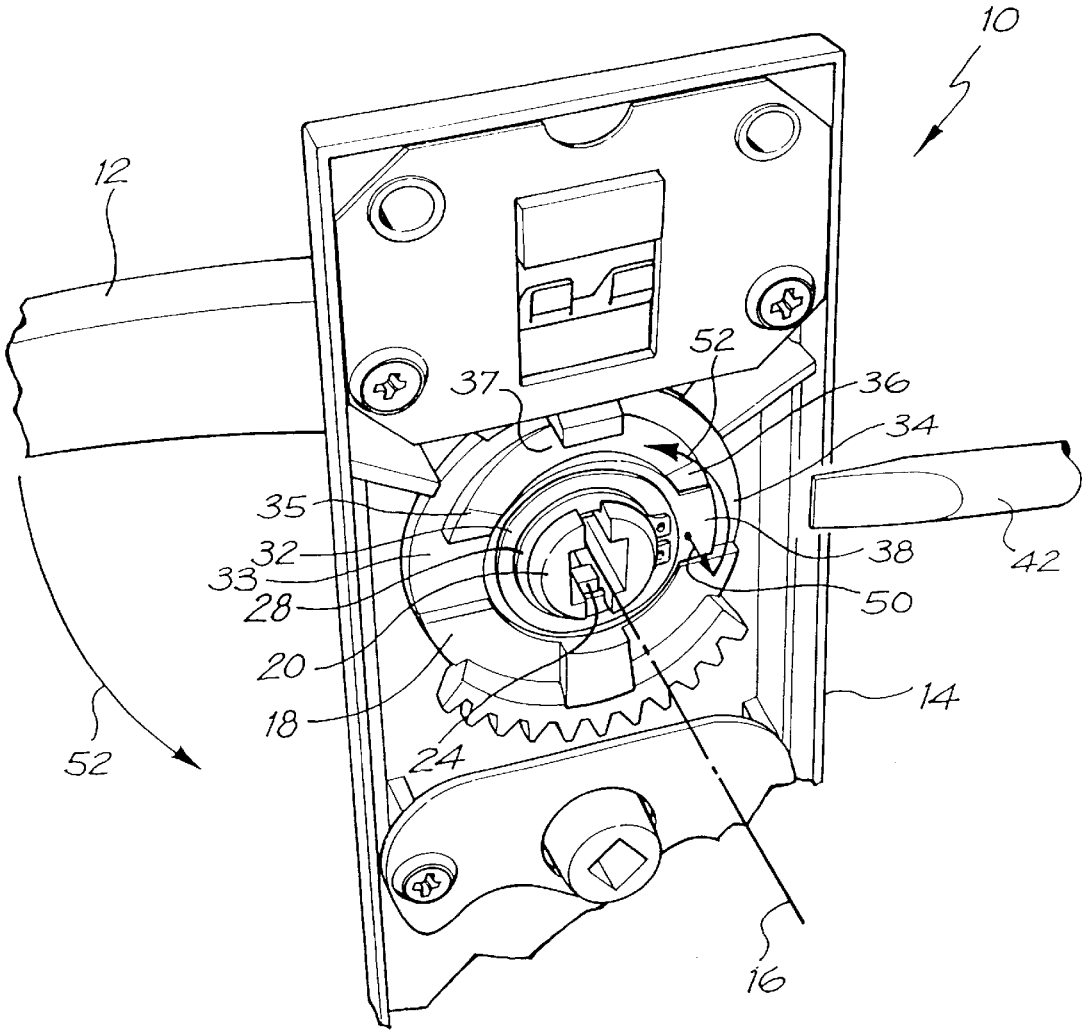
FIG. 1 is a partial perspective view of an embodiment of a handle mounting assembly.
Figure 2:
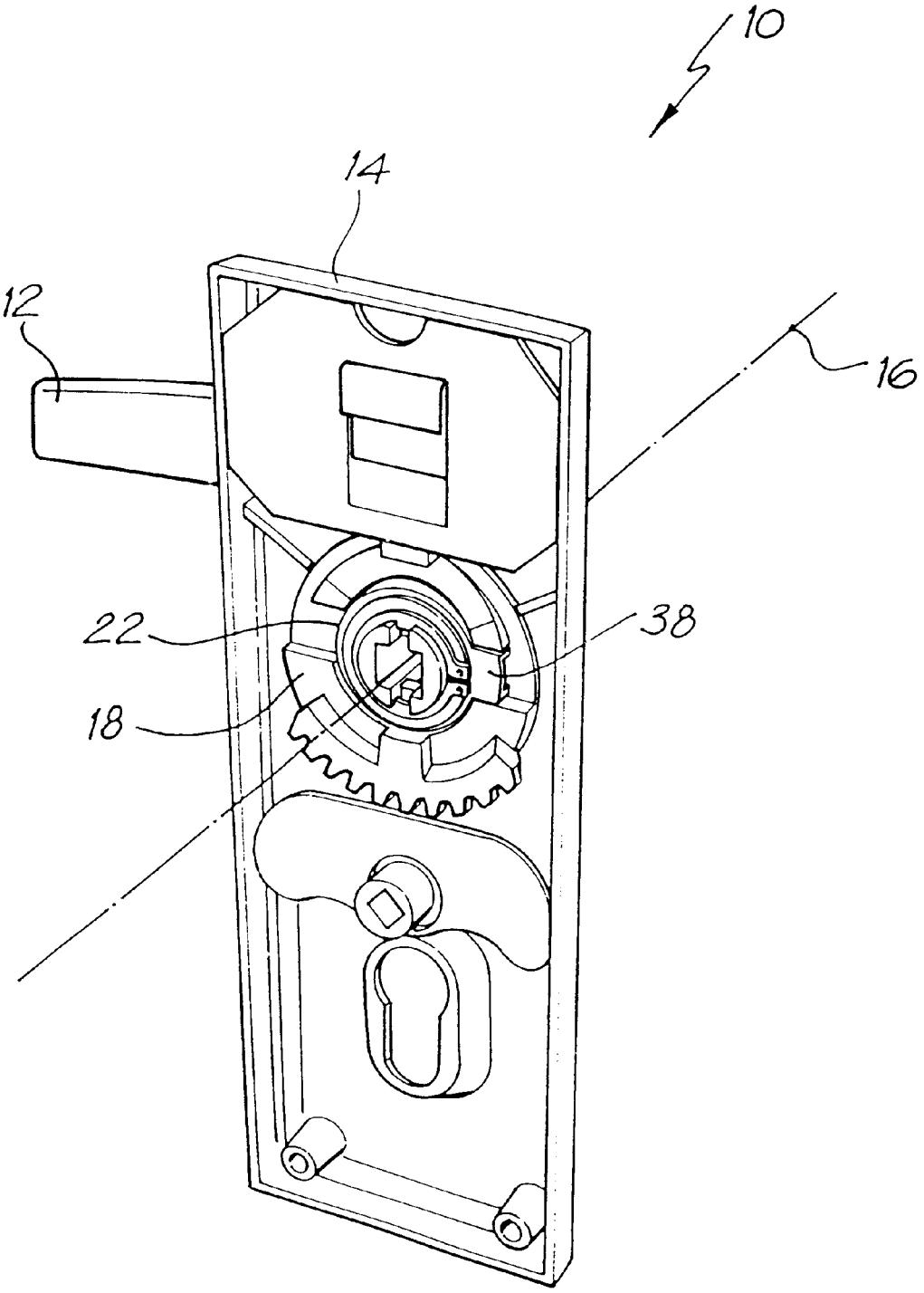
FIG. 2 is a full perspective view of the assembly shown in FIG. 1.

Referring to the drawings, there is shown a first embodiment of a handle mounting assembly 10. The assembly 10 includes a handle, in the form of lever handle 12, mounted to an escutcheon 14. The handle 12 is adapted for turning about an axis 16. The assembly 10 also includes a drive member 18 which is operable on a latch and/or lock mechanism 17 (see FIG. 3) to impart the rotational movement of the handle 12 to the latch and the lock mechanism 17 for actuating same in the normal manner.

Figure 4:
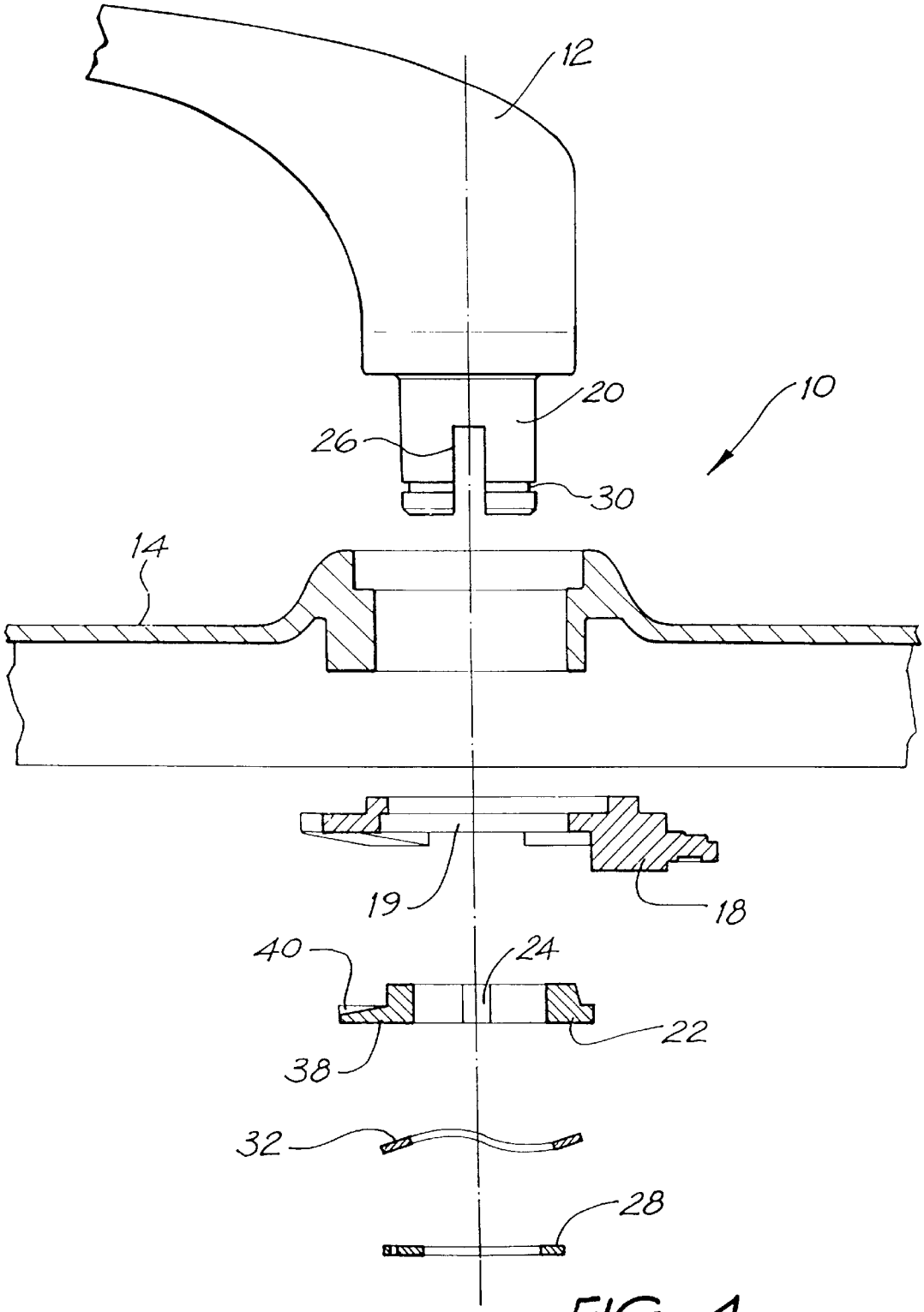

The drive member 18 is rotatably mounted at bore 19 to a spigot 20 provided on the escutcheon end of the handle 12. The assembly also includes a handing plate 22 non-rotatably mounted to the spigot 20 by a pair of inwardly facing teeth 24 on the handing plate engaging with corresponding recesses or slots 26 in the spigot 20. A cir-clip 28 engages a groove 30 (see FIG. 4) on the spigot 20 to retain all of the aforementioned components adjacent the escutcheon 14 in the order shown in FIG. 4. A spring means in the form of resilient wave washer 32 (see FIG. 4) disposed between the cir-clip 28 and the handing plate 22 biases all of the components towards the escutcheon plate 14.

The drive member 18 includes a pair of opposed recesses 33 and 34 separated by 180° of rotation about the axis 16 by inclined camming surfaces 35 and 36 respectively leading to an intermediate shallow surface 37.

The handing plate 22 includes a locking tab 38 adapted to individually engage the recesses 33 and 34 to non-rotatably engage the handing plate 22, and thus the handle 12, with the drive member 18.

The distal end of the tab 38 includes a cut-out 40 which is adapted to receive the blade end of the screwdriver 42 or like tool for moving or pivoting the tab 38 out of engagement with one of the recesses 34, as indicated by arrow 50. In relation to a starting orientation shown in FIG. 1, this allows the handle 12 to be rotated relative to the mounting plate 18 along the camming surface 36, shallow surface 37 and camming surface 35 and into engagement with the other of the recesses 33 to alter the orientation of the handle 12 by 180°, as indicated by arrows 52. When the tab 38 has passed the camming surface 35 adjacent the recess 33 it is forced into locking engagement with the recess 33 by the biasing action of the wave washer 32.

Figure 3:
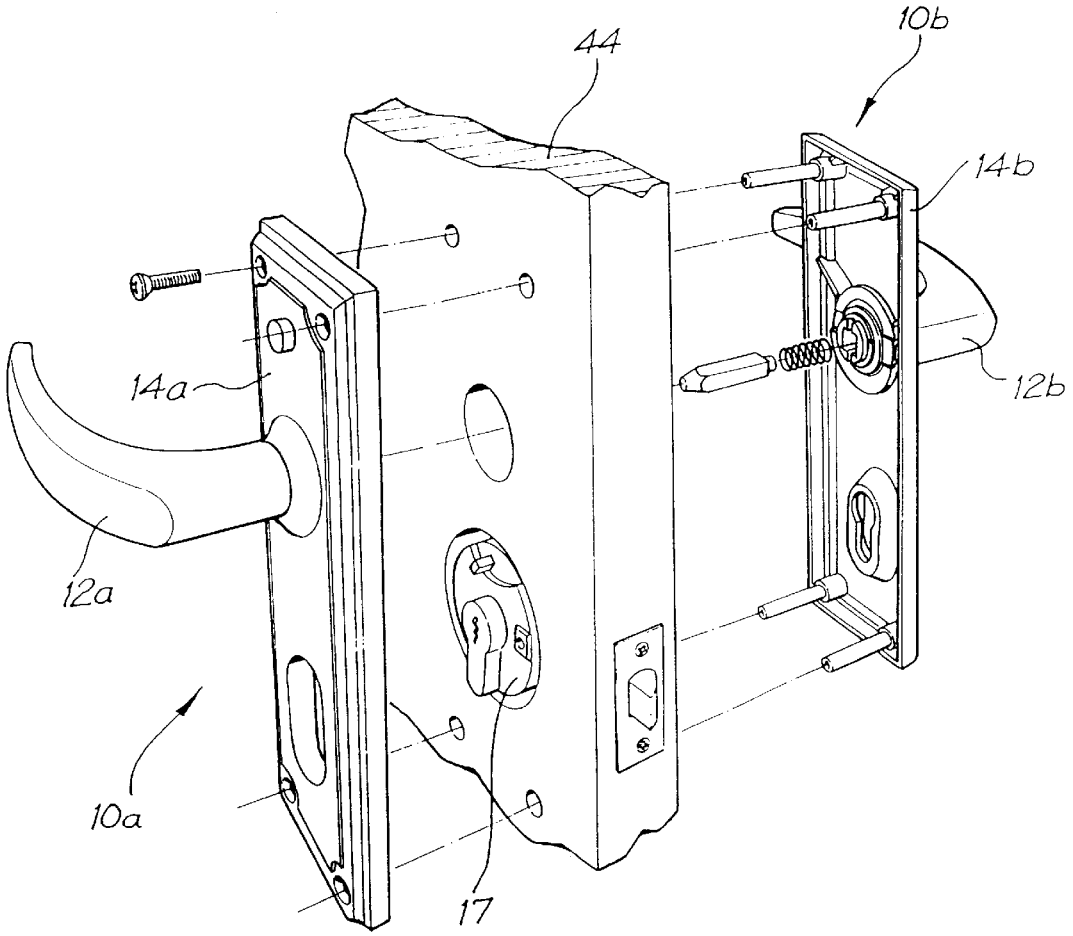
FIG. 3 an exploded perspective view of a pair of the assemblies of FIG. 1 adjacent a door; a FIG. 4 is an exploded sectional side view of the assembly shown in FIG. 1.

The two configuration of the assembly 10 are illustrated in FIG. 3 which shows an assembly 10*a* on the left side of door 44 with the free end of the handle 12*a* pointing towards the left side of the escutcheon 14*a* and an assembly 10*b* on the right hand side of the door 34 with the free end of the handle 12*b* pointing to the right side of the escutcheon 14*b*.

The primary advantage of the handle mounting assembly is that the orientation of the handle relative to the escutcheon can be quickly and easily altered to adapt the escutcheon and mounting assembly to any door or like component installation. Accordingly, only one mounting assembly is required for all possible installations which reduces inventory and avoids incorrect ordering.

Another advantage is that the handle escutcheon and mounting assembly can be pre-assembled which reduces the opportunity for incorrect assembly on-site. The pre-assembled unit can also be arranged with the tab adjacent the intermediate portion so that the handle is approximately parallel with the escutcheon to reduce packaging size. When packaged in this way, the handle can be quickly and easily oriented in the correct manner by simply turning the handle relative to the escutcheon without the need for any tools. In the event that the initial orientation chosen is incorrect, the orientation may be easily altered with the use of a screwdriver or like tool as previously discussed.

Whilst the primary application of the handle mounting assembly is with non-symmetrical handles, such as lever handles, it can also be used with for example, symmetrical handles, such as knobs which carry some form of indicia which has a preferred orientation relative to the door or other component to which the handle is being mounted.

Although the invention has been described with reference to a specific example, it will be appreciated by those skilled in the art, that the invention maybe embodied in many other forms. As an example, the drive member can have more than two recesses in order to provide more than two available handle positions relative to the escutcheon.

The claims defining the invention are as follows:

1. A handle mounting assembly including:

a handle adapted for turning about an axis;

a drive member adapted to operate a latch and/or lock mechanism, the drive member being rotatably mounted on the handle; and a handing plate non-rotatably mounted to the handle, the handing plate having means for non-rotatably engaging the drive member in at least two angularly spaced apart positions relative to the axis of the handle to connect the drive member to the handle for rotation with the handle;

wherein said means permits movement of the handing plate from one of said at least two positions to another of said at least two positions without removal of said handing plate and said drive member from said handle.

2. An assembly as claimed in claim 1, wherein the handle is non-symmetric about its rotational axis.

3. An assembly as claimed in claim 2, wherein the handle is a lever handle.

4. An assembly as claimed in claim 1, wherein the drive member includes at least two first engaging formations adapted for individual engagement with a corresponding engaging formation provided on the handing plate.

5. An assembly as claimed in claim 4, wherein the drive member includes a pair of opposed recesses and the handing plate includes a correspondingly sized locking tab.

6. An assembly as claimed in claim 4, wherein the handing plate includes second engaging portions adapted to engage with second complementary engaging formations provided on the handle.

7. An assembly as claimed in claim 6, wherein the handle includes a spigot having a pair of opposed recesses into which is received a pair of opposed teeth provided on the handing plate.

8. An assembly as claimed in claim 7, wherein the handing plate locking tab is moveable in an axial direction in and out of engagement with the recesses.

9. An assembly as claimed in claim 8, wherein the handing plate is biased against the drive member by a spring means.

10. An assembly as claimed in claim 9, wherein the handle, the drive member and the handing plate are all biased towards an escutcheon plate by the spring means.

11. An assembly as claimed in claim 10, wherein the spring means is in the form of a wave washer.

12. An assembly as claimed in claim 11, wherein the wave washer is retained on the handle spigot by cir-clip engaging a groove therein.

* * * * *